US009770837B2

(12) United States Patent
Heine et al.

(10) Patent No.: US 9,770,837 B2
(45) Date of Patent: Sep. 26, 2017

(54) KNIFE SHEATH

(71) Applicant: Fiskars Finland Oy Ab, Helsinki (FI)

(72) Inventors: Mikko Heine, Helsinki (FI); Petteri Masalin, Helsinki (FI); Teemu Sandelin, Helsinki (FI)

(73) Assignee: Fiskars Finland Oy Ab, Helsinki (FI)

( * ) Notice: Subject to any disclaimer, the term of this patent is extended or adjusted under 35 U.S.C. 154(b) by 0 days.

(21) Appl. No.: 15/427,646

(22) Filed: Feb. 8, 2017

(65) Prior Publication Data

US 2017/0246752 A1 Aug. 31, 2017

(30) Foreign Application Priority Data

Feb. 29, 2016 (FI) ..... 20165156

(51) Int. Cl.

| | |
|---|---|
| ***B26B 29/02*** | (2006.01) |
| ***B26B 3/06*** | (2006.01) |
| ***B24B 3/54*** | (2006.01) |
| ***A45F 5/02*** | (2006.01) |

(52) U.S. Cl.

CPC ..... *B26B 29/025* (2013.01); *A45F 5/021* (2013.01); *B24B 3/54* (2013.01)

(58) Field of Classification Search

CPC ..... B24D 15/08; B24B 15/08; B26B 29/02; B26B 3/06

USPC ..... 224/245, 242

See application file for complete search history.

(56) References Cited

U.S. PATENT DOCUMENTS

| | | | | |
|---|---|---|---|---|
| D140,745 | S | 4/1945 | Fairbairn et al. | |
| 2,767,530 | A * | 10/1956 | Paldanius | B24D 15/084 224/232 |
| 3,676,961 | A | 7/1972 | Jackson | |
| 4,091,691 | A * | 5/1978 | Bayly | B24D 15/084 30/138 |
| 4,669,337 | A | 6/1987 | Petroff | |
| 4,794,738 | A | 1/1989 | Brignoli | |
| 4,866,845 | A * | 9/1989 | McEvily | B24D 15/084 30/138 |
| 4,869,027 | A * | 9/1989 | McEvily | B26B 29/025 30/138 |
| 5,211,322 | A * | 5/1993 | Nealy | B26B 29/025 224/230 |
| D374,981 | S | 10/1996 | Hainsworth | |

(Continued)

FOREIGN PATENT DOCUMENTS

GB 826867 A 1/1960

OTHER PUBLICATIONS

Finnish Search Report, App. No. 20165156, Fiskars Finland Oy Ab, 2 pages (dated Sep. 16, 2016).

*Primary Examiner* — Brian D Nash
(74) *Attorney, Agent, or Firm* — Foley & Lardner LLP

(57) ABSTRACT

A knife sheath includes a receptacle and an attachment piece for suspending the knife sheath from a user. The knife sheath is provided with a collar which is detachably attached to the receptacle at an opening. An edge receiving portion of the collar is provided with a sharpener that imparts a sharpening action to a blade of a knife which is introduced into the receptacle. The receptacle and the collar are shaped to allow the collar and receptacle to be attached to each other in a first position and in an alternative second position such that the knife sheath is suitable for both left-handed and right-handed users.

10 Claims, 2 Drawing Sheets

(56) References Cited

U.S. PATENT DOCUMENTS

| | | | | |
|---|---|---|---|---|
| 6,224,475 | B1 * | 5/2001 | May | B24D 15/084 30/298.4 |
| 7,469,475 | B2 * | 12/2008 | Wong | B01J 2/20 30/151 |
| D591,040 | S | 4/2009 | Foster | |
| D672,549 | S | 12/2012 | McLean | |
| D746,585 | S | 1/2016 | Burge et al. | |
| 9,452,508 | B2 * | 9/2016 | Beechinor | B24D 15/084 |
| 2012/0180602 | A1 * | 7/2012 | Murphy | B26B 29/025 76/82 |

* cited by examiner

KNIFE SHEATH

CROSS-REFERENCE TO RELATED APPLICATIONS

This application claims the benefit of and priority to Finland Patent Application No. 20165156, filed Feb. 29, 2016, the entire contents of which are incorporated herein by reference.

BACKGROUND OF THE INVENTION

Field of the Invention

This invention relates to a knife sheath with an attachment piece for attaching and suspending the knife sheath from clothing or a belt of a user.

Description of Prior Art

Previously there is known a knife sheath comprising a receptacle with an opening via which a blade of a knife may be introduced into the receptacle. An attachment piece protruding from the receptacle facilitates that the user may attach and suspend the knife sheath with the knife from clothing or from a belt, for instance. In this way the knife is always easily available for the user when needed.

In the known knife sheath the receptacle is manufactured to enclosed the blade of the knife from all sides in order to prevent that the edge of the knife by accident causes injury to the user or to the surroundings. Simultaneously, the knife sheath ensures that the edge of the knife remains sharp by not accidentally coming into contact with hard objects which might eventually make the knife dull. This is, however, not sufficient in all situations to ensure that the user always has access to a sharp knife located in a comfortable place from where the user easily can grab the knife with one hand.

SUMMARY OF THE INVENTION

An object of the present invention is to solve the above mentioned drawback by providing a knife sheath capable of providing a user with access to a sharp knife located at an easily accessible place. This object is achieved with a knife sheath according to independent claim 1.

The use of a knife sheath with a collar where an edge receiving portion has a sharpener ensures that the knife can be efficiently sharpened while it is introduced into and/or removed from the receptacle of the knife sheath. Additionally, as the receptacle can be rotated into alternative positions with respect to the collar, the user can freely select whether the attachment piece of the knife sheath should be located on a left side or on a right side a knife whose edge is received by the edge receiving portion of the collar. This makes it possible for the user to suspend the knife sheath at a location which is as comfortable as possible, irrespectively whether the user is right-handed or left-handed.

BRIEF DESCRIPTION OF DRAWINGS

In the following the present invention will be described in closer detail by way of example and with reference to the attached drawings, in which.

DESCRIPTION OF AT LEAST ONE EMBODIMENT

Figure 1:
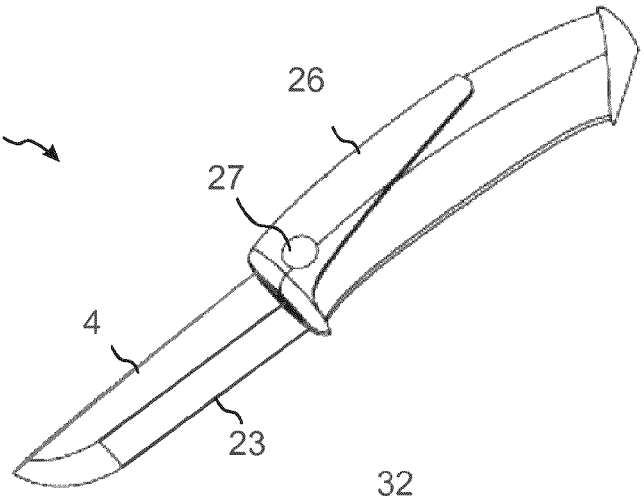
FIG. 1 illustrates a knife.
Figure 2:
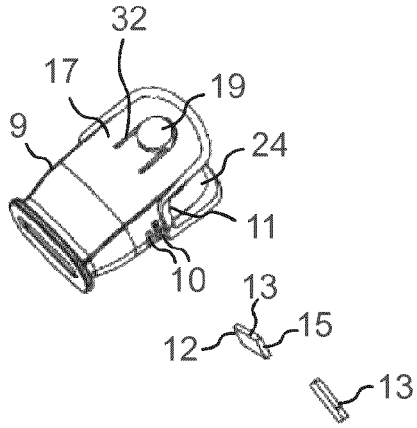
FIG. 2 illustrates a collar of a knife sheath.
Figure 3:
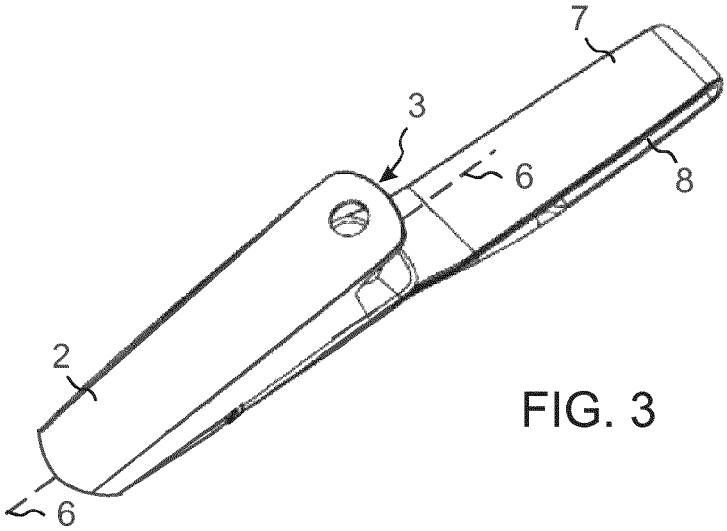
FIG. 3 illustrates a receptacle of a knife sheath.

FIGS. 1 to 3 illustrate parts of a knife sheath and a knife which may be received in the knife sheath.

The knife sheath 1 comprises a receptacle 2 with an opening 3 for receiving and enclosing a blade 4 of a knife 5. The blade 4 of the knife 5 is introduced into the receptacle by moving it along a longitudinal axis 6 of the receptacle 2. FIG. 1 illustrates a knife 5 with the sharp edge 23 of the blade 4 turned downwards, such that the left side of the knife can be seen.

An attachment piece 7 protrudes from the receptacle 2. A user may attach and suspend the knife sheet from clothing or a belt of the user by using this attachment piece. For this purpose an outer end of the attachment piece 7 may be provided with a loop 8 through which a belt may protrude. Alternatively, the outer end of the attachment piece 7 may be provided with a hook or a slot opening for mounting on a button, for instance.

In the illustrated knife sheath 2 a collar 9 is utilized. This collar 9 may be detachably attached to the receptacle 2 at the opening 3. In the illustrated example the attachment is carried out by pushing the collar 9 into the opening 3 until a part of the collar 9 protrudes into the receptacle 2. The collar is provided with an opening allowing a blade of a knife to be inserted into the receptacle via the opening in the collar.

FIG. 2 illustrates that at least one through hole 10 is provided in an edge receiving portion 11 of the collar 9. A first end 12 of at least one stone 13 of a sharpener is introduced into the edge receiving part of the collar 9 via this hole 10. With the stone 13 in this position the collar 9 is attached to the receptacle. During use an inner surface 14 (as best seen in FIG. 4) of the receptacle 2 may come into contact with a second end 15 of the stone 13, such that the stone 13 is supported in the hole 10 due to contact between the second end 15 of the stone 13 and the inner surface 14 of the receptacle 2.

Figure 4:
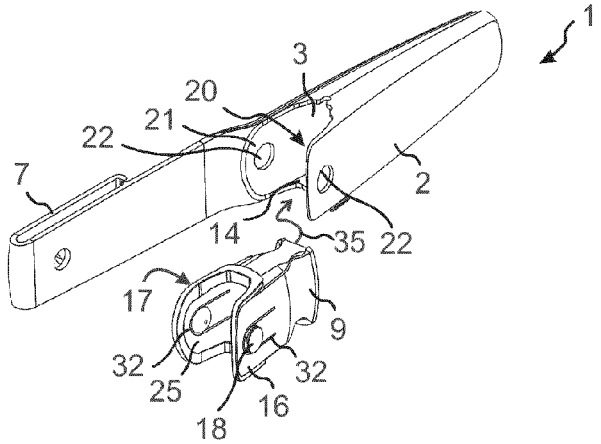
FIGS. 4 to 6 illustrate attachment of the collar to the receptacle.
Figure 5:
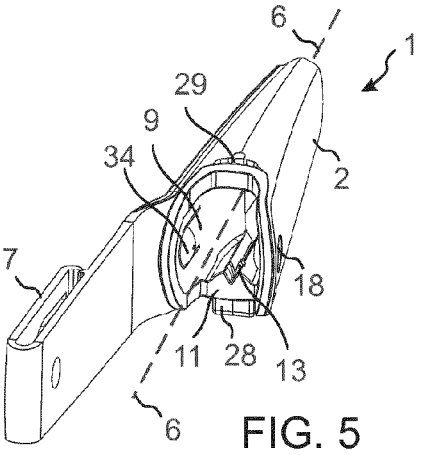
Figure 6:
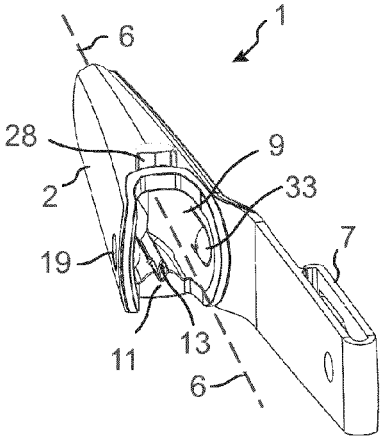

FIGS. 4 to 6 illustrate attachment of the collar 9 to the receptacle 2. The collar 9 and receptacle 2 in FIGS. 4 to 6 are identical to those illustrated in FIGS. 2 and 3.

After the stone 13 (or stones in the illustrated example) has been arranged in place in the hole 10, the collar 9 is attached at the opening 3 by moving a front part of the collar 9 into the receptacle as illustrated by the arrow 35 in FIG. 4. The collar is provided with a first outer side surface 16 and with a second outer side surface 17. The first outer side surface 16 is provided with a first flexible protrusion 18 with an outer end protruding outwards from the first outer side surface 16. Similarly the second outer side surface 17 is provided with a second flexible protrusion 19 protruding outwards from the second outer side surface 17. The receptacle 2 is provided with a first 20 and a second 21 inner side surface with a respective cavity 22 for receiving the outer ends of the first 18 and second 19 flexible protrusions. In the illustrated example the cavities 22 consist of holes extending through the collar. Consequently, when the front part of the collar 9 is moved into the receptacle 2, the outer ends of the first 18 and second 19 flexible protrusions engage the cavities 22 and lock the collar to the receptacle 2. This locking can, however, be released by pushing the outer ends of the first 18 and second 19 flexible protrusions out of the cavities 22 from the outside of the receptacle 2.

FIG. 5 illustrates the collar 9 attached to the receptacle 2 at the opening 3 in a first position. In this example the edge receiving portion 11 of the collar 9 is located at the bottom of the collar, as seen in FIG. 5. When a blade 4 of a knife 5 is received in the knife sheath 1 while the collar 9 and knife sheath 1 remain attached to each other in this first position, the sharp edge 23 of the knife 5 is directed downwards, and consequently, the attachment piece 7 is located on the left side of the knife 5.

In FIG. 6 the same collar 9 and receptacle 2 are illustrated. However, prior to attaching the collar 9 to the receptacle 2, the receptacle has been turned 180° around the longitudinal axis 6 of the receptacle 2. Again, as the collar 9 has not been rotated as compared to FIG. 5, the edge receiving portion 11 of the collar is located at the bottom of the collar. When a blade 4 of a knife 5 is received in the knife sheath 1 while the collar and receptacle remain attached to each other in this second position, the sharp edge 23 of the knife 5 is directed downwards, and consequently, the attachment piece 7 is located on the right side of the knife 5.

Due to the possibility of attaching the collar and receptacle to each other in the two alternative positions illustrated in FIGS. 5 and 6, a user may suspend the knife sheath at a location which is as comfortable as possible, irrespectively if the user is right-handed or left-handed.

The edge receiving portion 11 is provided with a sharpener including at least one stone 13. The first ends of the stones 13 can be seen in FIGS. 5 and 6. The stones may be such located that the sharpener does not provide a sharpening action to an edge 23 of a blade 4 of a knife every time the knife is introduced into the receptacle 2 through the opening 3, unless the user chooses to introduce the knife in such a way into the receptacle that sharpening action occurs. When sharpening is needed, the user may pull in and out the blade 4 from the receptacle 2 as many times as needed while pushing the edge 23 towards the stones 13 in order to obtain a suitable amount of sharpening action to the edge 23 of the blade.

In order to ensure that a knife placed in the knife sheath 1 firmly remains with the blade 4 within the receptacle 2, the first flexible protrusion 18 and the second flexible protrusion 19 are provided with a respective inner end 33, 34 protruding inwards from a first inner surface 24 and a second inner surface 25 of the collar 9, respectively. When a blade 4 of a handle is introduced into the receptacle 2, the inner ends 33, 34 of the first 18 and second 19 flexible protrusions come into contact with the handle 26 of the knife. Due to this contact the handle 26 and the entire knife 5 remains firmly in position in the knife sheath 1. In the illustrated example it has by way of example been assumed that the handle 26 of the knife 5 has a cavity 27 on the left and right side surface of the handle for engagement with the inner ends 33, 34 of the first 18 and second 19 flexible protrusions.

The receptacle 2 and the collar 9 may be manufactured of a suitable plastic material, for instance. In that case an U-shaped groove 32 may be provided in the left and right side walls of the collar 9 such that a plastic flexible area serving as a part of the first 18 and second 19 flexible protrusions can be obtained. With such a construction the entire collar may be manufactured as one single part of one single material.

Figure 7:
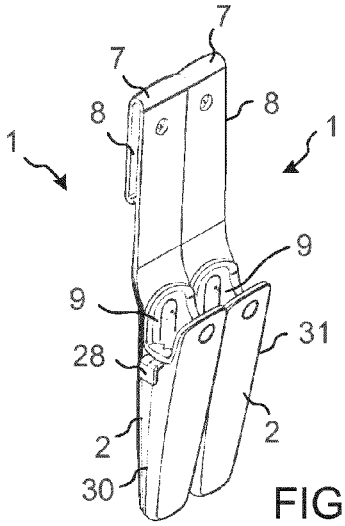
FIG. 7 illustrates two knife sheaths attached to each other.

FIG. 7 illustrates attachment of two knife sheaths 1 to each other. The illustrated knife sheaths are the same as illustrated in the previous figures, consequently, two similar attachment knife sheaths are attached to each other.

To facilitate such attachment, the knife sheaths 1 are both provided with a first attachment member 28, such as a hook, and a second attachment member 29, such as a hole. The first 28 and second 29 attachment members are shaped as each other counter parts to facilitate attachment by threading the hook into the hole, for instance.

The first 28 and second 29 attachment members are located on opposite front 30 and back 31 surfaces of the knife sheaths 1. In this way the front surface 30 of the first knife sheath 1 may be attached to the back surface 31 of the second knife sheath 1. The result is that blades of knifes received in these attached knife sheaths are in line with each other and the attachment pieces of the knife sheaths 7 are located on the same left or right side of the knifes, as illustrated in FIG. 7. In this way the same belt may be threaded through loops 8 of both knife sheaths 1. The user can therefore comfortably carry two or more knifes that remain connected and therefore more firmly in place while avoiding that the combined knife sheaths would protrude outwards from the clothes of the user more than absolutely necessary.

Figure 8:
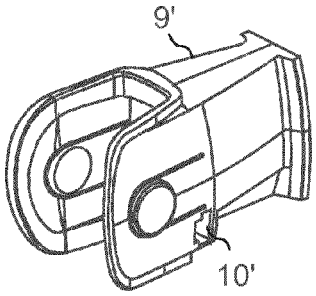
FIG. 8 illustrates a second embodiment of a collar.

FIG. 8 illustrates a second embodiment of a collar 9'. The collar 9' illustrated in FIG. 8 is very similar to the collar illustrated in the previous figures. Therefore the embodiment of FIG. 8 is explained mainly by pointing out the differences as compared to the previous embodiment.

In the collar 9' of FIG. 8 the hole 10' for introducing an end of at least one stone of a sharpener is differently located than in the previous embodiment. In FIG. 8 this hole 10' is located in a first side surface of the collar 9'. The collar of FIG. 8 can be utilized in connection with the receptacle illustrated in the previous figures.

It is to be understood that the above description and the accompanying figures are only intended to illustrate the present invention. It will be obvious to a person skilled in the art that the invention can be varied and modified without departing from the scope of the invention.

The invention claimed is:

1. A knife sheath, comprising:

a receptacle with an opening for receiving and enclosing a blade of a knife which is introduced into the receptacle along a longitudinal axis of the receptacle, an attachment piece for suspending the knife sheath from a user, and a collar which is detachably attached to the receptacle at the opening, wherein an edge receiving portion of the collar is provided with a sharpener which provides a sharpening action to a blade of a knife which is introduced into the receptacle through the opening, the collar is provided with a first and second opposite outer side surface, the first outer side surface is provided with a first flexible protrusion with an outer end protruding outwards from the first outer side surface, and the second outer side surface is provided with a second flexible protrusion with an outer end protruding outwards from the second outer side surface, and the receptacle is provided with a first and second inner side surface with a respective cavity for receiving the outer ends of the first and second flexible protrusions for attaching the collar to the receptacle, wherein the receptacle and the collar are shaped to allow the collar and receptacle to be attached to each other in a first position and in an alternative second position such that in the second position the receptacle has been turned around the longitudinal axis of the receptacle as compared to the first position, wherein in the first position the attachment piece is located on the left side of a knife whose edge is received by the edge receiving portion of the collar, and in the second position the attachment piece is located on the right side of a knife whose edge is received by the edge receiving portion of the collar.

2. The knife sheath of claim 1, wherein the first flexible protrusion is provided with an inner end protruding inwards from a first inner side surface of the collar for contacting a handle of a knife whose blade is received in the receptacle, and the second flexible protrusion is provided with an inner end protruding inwards from a second inner side surface of the collar for contacting a handle of a knife whose blade is received in the receptacle.

3. The knife sheath according to claim 1, wherein the knife sheath is provided with a first attachment member and with a second attachment member, wherein the second attachment member is configured to receive a first attachment member of a second similar knife sheath for attaching the knife sheaths to each other.

4. The knife sheath according to claim 3, wherein the first attachment member and the second attachment member are located on an opposite front and back surface of the knife sheaths for attaching the knife sheaths to each other in a position where blades of knives received in the knife sheaths are in line with each other and where the attachment pieces of the knife sheaths are located on the same left or right side of the respective knifes whose blades are received in the knife sheaths.

5. The knife sheath according to claim 1, wherein the sharpener includes at least one stone providing a sharpening action to the edge of the blade and the edge receiving portion of the collar is provided with at least one through hole for receiving a first end of the at least one stone of the sharpener, a second opposite end of the at least one stone is supported by an inner surface of the receptacle which covers said hole while the collar is attached to the receptacle.

6. A knife sheath, comprising:

a receptacle with an opening configured to receive a blade of a knife which is introduced into the receptacle along a longitudinal axis of the receptacle;

an attachment piece configured to suspend the knife sheath from a user, and a collar having an edge receiving portion, the collar detachably coupled to the receptacle at the opening;

a sharpener disposed proximate the edge receiving portion of the collar, the sharpener configured to impart a sharpening action to the blade of the knife which is introduced into the receptacle through the opening;

the collar includes a first outer side surface and an opposite second outer side surface, the first outer side surface having a first flexible protrusion with an outer end protruding outwards from the first outer side surface, and the second outer side surface having a second flexible protrusion with an outer end protruding outwards from the second outer side surface;

the receptacle includes a first inner side surface and a second inner side surface with a respective cavity for receiving the outer ends of the first and second flexible protrusions for attaching the collar to the receptacle;

wherein the receptacle and the collar are interchangeably attachable to each other in a first position and in a second position, such that in the second position the receptacle has been rotated about the longitudinal axis by 180 degrees as compared to the first position.

7. The knife sheath of claim 6, wherein the first flexible protrusion is provided with an inner end protruding inwards from a first inner side surface of the collar for contacting a handle of a knife whose blade is received in the receptacle, and the second flexible protrusion is provided with an inner end protruding inwards from a second inner side surface of the collar for contacting a handle of a knife whose blade is received in the receptacle.

8. The knife sheath according to claim 6, wherein the knife sheath is provided with a first attachment member and with a second attachment member, wherein the second attachment member is configured to receive a first attachment member of a second similar knife sheath for attaching the knife sheaths to each other.

9. The knife sheath according to claim 8, wherein the first attachment member and the second attachment member are located on an opposite front and back surface of the knife sheaths for attaching the knife sheaths to each other in a position where blades of knives received in the knife sheaths are in line with each other and where the attachment pieces of the knife sheaths are located on the same left or right side of the respective knifes whose blades are received in the knife sheaths.

10. The knife sheath according to claim 6, wherein the sharpener includes at least one stone providing a sharpening action to the edge of the blade and the edge receiving portion of the collar is provided with at least one through hole for receiving a first end of the at least one stone of the sharpener, a second opposite end of the at least one stone is supported by an inner surface of the receptacle which covers said hole while the collar is attached to the receptacle.

* * * * *